US005826837A

United States Patent [19]

Moineau et al.

[11] Patent Number: 5,826,837

[45] Date of Patent: Oct. 27, 1998

[54] SANDBAG FILLING AND SUPPORT APPARATUS AND METHOD

[75] Inventors: Christopher P. Moineau; James D. Scerra, both of Marlboro, Mass.

[73] Assignee: Automatic Specialties, Inc., Marlboro, Mass.

[21] Appl. No.: 762,397

[22] Filed: Dec. 9, 1996

[51] Int. Cl.[6] ..... A63B 55/04

[52] U.S. Cl. ..... 248/97; 248/153; 248/175

[58] Field of Search ..... 248/97, 99, 907, 248/150, 153, 155.2, 164, 439, 95, 175

[56] References Cited

U.S. PATENT DOCUMENTS

| | | | |
|---|---|---|---|
| 3,603,541 | 9/1971 | Sturm | 248/150 |
| 3,627,242 | 12/1971 | Vandermast | 248/97 |
| 3,638,888 | 2/1972 | Ross | 248/97 |
| 4,646,802 | 3/1987 | Basore et al. | 248/97 |
| 4,723,741 | 2/1988 | Doering | 248/97 |

*Primary Examiner*—Ramon O. Ramirez
*Assistant Examiner*—Willie Berry, Jr.
*Attorney, Agent, or Firm*—Richard P. Crowley

[57] ABSTRACT

A bag holder and support apparatus and method which provides a simple, inexpensive device to support sandbags and accelerate the filling of the bag with material while in the supported position. The bag holder is designed to move between a collapsible, generally flat, non-use position where it may be stored or shipped quite easily, and an upright, easily assembled use position for use in supporting and filling purposes. The invention includes a method of preparing the bag holder apparatus and filling an open-ended bag with material by providing a bag holder apparatus and placing the apparatus in a upright assembled use position by snapping in one end of the single wire element to the top or bottom peripheral wire element, and then placing an open-ended bag to be filled within the wire elements, and bending the material of the bag against and about the top peripheral wire element to place the open end of the bag in an open supported position to permit filling of the bag material, and then filling the bag with material in such open-ended support position, and optionally then sealing the bag after filling and placing the bag in a desired position. The bag support apparatus may then be placed in the compact, generally flat non-use position by unsnapping the wire element and collapsing the other elements into the generally flat position.

15 Claims, 8 Drawing Sheets

SANDBAG FILLING AND SUPPORT APPARATUS AND METHOD

BACKGROUND OF THE INVENTION

Sandbags are comprised of bags generally made of a fabric material, like a burlap or plastic material, and have a one open end designed to be filled with material, such as particulate material, like sand or soil, and to serve as a ballast, for example, for use in fortifications for a section of a waterway or dikes and the like. Sandbags are usually filled by having one person hold the one open end of the sandbag, while another person shovels or otherwise directs the particulate material into the open end of the supported sandbag, until the bag is filled to the desired level. The open end of the filled bag is then usually sealed, such as by using a bag tie, sewing, clamps, clasps or other means, and then the sandbag is placed in its desired position.

While filling sandbags in this manner is satisfactory, it is time consuming and requires at least two people and is not desirable where quick filling and use of sandbags is desired, such as in emergency-type situations. Prior art devices and apparatus have been used to support bags, such as sandbags, in a supported open position in order to accelerate the filling of the sandbags with material. However, it is desired to provide for a new and improved, inexpensive, easily manufactured sandbag holder and support apparatus to permit the rapid filling of a bag by a single person, and in particular it is also desirable to provide for a bag support holder apparatus, which when unassembled is compact and may be easily stored or shipped as required, and which may easily move from a compact non-use position to an assembled use position on the site of use.

SUMMARY OF THE INVENTION

The invention relates to a holder or support apparatus to support a bag and to facilitate the filling of an open end of the supported bag, and in particular the apparatus of the invention is directed to an apparatus and method of a bag holder and support apparatus which moves between a collapsed, generally flat, non-use position and an upright assembled use position.

The bag holder and support apparatus and method of the invention provides a simple, inexpensive device to support bags, such as a sandbag having an open end, and accelerates the filling of the bag with material, while in the supported position. The bag holder apparatus of the invention is designed to move between a collapsible, generally flat non-use position where it may be stored or shipped quite easily, and an upright, easily assembled use position for use in supporting and filling purposes. The bag holder apparatus is easily and inexpensively manufactured by employing metal wires of sufficient strength and diameter to provide the necessary support, and can be easily manufactured by cutting and bending the wire to form the holder apparatus.

The bag holder apparatus, formed of a wire frame assembly, is employed by placing the bag holder apparatus in an assembled use position, and setting the assembled apparatus on the ground with the large diameter periphery on the ground, and then inserting an open ended bag within the smaller diameter wire periphery, the neck of the bag curled or otherwise secured about the outside of the smaller peripheral wire element to retain the bag in a supported open end position, and which permits filling of the bag. After the bag is filled to the desired level, the bag may be easily removed and the bag sealed or used as desired.

The bag holder support apparatus of the invention and the method of use and manufacture provides for an apparatus which facilitates the filling of a sandbag having an open end with material, such as particulate material, more particularly sand and soil, and may contain any type of material and be filled in any type of an open ended bag. The bag holder apparatus moves between a collapsible, generally flat non-use position and the elements are hingedly moved and snap-fitted together into an upright assembled use position for use with the open end bag.

The bag holder apparatus comprises a peripheral bottom wire element which forms a bottom base or stand for the apparatus in the assembled position. The peripheral bottom wire may be formed in any particular shape, but generally is circular or oval in shape and of sufficient diameter and dimensions to provide a firm base or stand for retaining the bag in the supported position. The bag holder then includes a peripheral top wire element, generally of a size and dimension to be about the same dimension, or slightly less the dimension, of the open end of the bag to be filled, and adapted to hold open the open end of the bag by curling the outer surface of the open end of the bag about the exterior surface of the peripheral top wire element. The top wire element of the bag holder apparatus is smaller in dimension than the bottom base or stand wire element, and generally is of the same shape, but may vary in shape as desired, and typically is either circular or an oval shape. The bag holder apparatus includes a crossed wire support element with the tops of each spaced apart, and the bottoms spaced apart, the top ends and the bottom ends hingedly secured respectively to said top wire element and said bottom wire elements, thereby to permit the top and bottom wire elements to hingedly move into the compact, non-use position, and yet to provide for the crossed wire support element to support the one side of the top and bottom peripheral wire elements in the assembled position.

The bag holder apparatus also includes a single wire support element, having a top end and a bottom end, adapted to be placed on the opposite side from the crossed wire element, each end hingedly secured respectively to the top and bottom of the peripheral wire elements, and at least one of said ends of the single wire support element being removably snap-fitted onto the top or bottom peripheral wire elements in the assembled position, and permitted to be unsnapped and placed so that the wire element may be placed in a flat position in the non-use position.

While in the preferred embodiment only one end of the wire support element is removable, it is recognized that all vertical wire elements, i.e. the single and crossed wire elements, may have removable snap-fastened hinges, to provide for a two, three or four section apparatus, or any combination thereof.

The bag holder also includes retaining means on the top and bottom peripheral wire elements to retain the top and bottom ends of the two-piece crossed wire elements and the single wire support element in a supported position when in the assembled use position, which retaining means permit the bag holder apparatus to form a compact, generally flat nonuse position.

Generally, the retaining and upright support means may be any desired means from the top and bottom of the peripheral wire elements to provide for additional support to the crossed wires and the single wire element when the bag holder is placed in the assembled use position. One retaining means which is found to be particularly effective comprises an elongated U-shaped top retaining wire element secured at either end to the peripheral top wire element, wherein the top ends of the crossed wire elements are hingedly secured within the elongated U-shaped retaining element and against the peripheral top wire element, and typically where the retaining element is angled slightly downward from the plane of the peripheral top wire element, so that when the crossed wire element is in the generally upright vertical position in the assembled use position, the top of the crossed wire elements contact and are supported by the elongated U-shaped top retaining means. Similarly, an elongated bottom U-shaped wire retaining means element is secured to the bottom peripheral wire element and the bottom ends of the crossed wire elements are hingedly secured within and usually adjacent to the ends of the elongated U-shaped element, and the elongated U-shaped element generally extends generally perpendicularly from the plane of the bottom peripheral wire element a short distance. The top and bottom retaining elements extended thus provide for additional support against each of the ends of the crossed wire pieces in the assembled positions, and yet are not so obtrusive or of sufficient height to interfere with the compact nature of the bag holder in the compact position. The top and bottom retaining elements are thus positioned on the top and bottom of the cross wire elements to prevent movement thereof and also provide support and rigid alignment of the top and bottom peripheral elements to stabilize the bag holder apparatus in the upright use position.

The single wire element is generally positioned oppositely aligned the crossed wire juncture of the crossed wire element, and is retained by U-shaped retaining wires secured to the top and bottom peripheral wire elements.

In one preferred embodiment of the bag holder apparatus, both the top peripheral wire element and the bottom peripheral wire element are of a general oval shape wherein the crossed wire element is secured, such as by welding, at the intersection of the crossed wires to provide additional support.

The wire frame employed in the manufacture of the bag holder apparatus comprises a wire and most typically a rigid steel wire of a sufficient diameter and which may be plastic coated, having generally a diameter of ⅛" to ¼", which wire element may be easily formed having the ends bent to close and to provide a closed-end hinge, or bent to form a curve which may be snap-fitted in connection with the wire element, that moves between an assembled and nonassembled flat position. Where the bag holding apparatus on both top and bottom peripheral wire elements is oval or circular in shape, the top circular diameter or oval minor axis is about 8 to 11 inches, and the bottom oval or circular major axis is about 10 to 14 inches. The bag apparatus in the assembled use position has a height ranging about 14–18 inches, which is usually sufficient to provide for a base with a standard sandbag.

The crossed wire and the single wire elements employed in the bag holder apparatus are typically hingeably secured to the top and bottom peripheral wire elements by using a teardrop loop made of the wire elements at each end, with a hairpin wire located at the ends to maintain the bag holder in the use position, and yet to permit the crossed wire and single wire elements to be hingedly moved between the non-use and use positions. In the preferred illustrated embodiment, the one end, typically the bottom end of the peripheral wire element, is designed in a hook-type manner in order to permit the bottom or the top end to be snapped on the base, and the peripheral wire element and the bag holder is moved from the compact to the assembled position, and to be unsnapped to permit the bag holder to be moved back into the compact position until required for use again.

The invention includes the combination of a bag holder support apparatus as described and disclosed in the unassembled flat non-use position, together in combination with a bag typically having an open end, which bag is to receive filling material therein. The open ended bag is placed within the top and bottom oval of the bag filling apparatus, and the opened end is held open by the top peripheral wire element, with the bag material wrapped around the outside of the top peripheral wire element and rolled up to hold the bag in an open-ended support position. If desired, clasps, barbs or other means may be employed in the top peripheral wire element in order to maintain the open end of the bag in the open end position, so that the supported bag may be readily filled. Similarly, the bag is employed with a bag tie or other means to permit the bag to be tied at the one end and sealed up after filling.

The invention includes a method of preparing the bag holder apparatus and filling an open-ended bag with material, such as a sandbag, with soil or other material, which method comprises providing a bag holder apparatus as disclosed and placing the apparatus in an upright assembled use position by snapping in the one or the other end of the single wire element to the top or the bottom peripheral wire elements, and then placing an open-ended bag to be filled within the top and bottom peripheral wire elements, and bending the material of the bag or otherwise holding the open end of the bag material against and about the top peripheral wire elements to place the open end of the bag in an open supported position to permit filling of the bag material. The method then comprises filling the bag with material in such open-ended support position, and optionally then sealing the bag after filling and placing the bag in a desired position.

The bag support apparatus may then be placed in the compact, generally flat non-use position by unsnapping the one or the other end of the wire element and collapsing the other elements into the generally flat, knock-down position for storage or transportation or for further use.

The apparatus and method shall be described for the purposes of illustration only in connection with a collapsible sandbag holder and method of filling same; however, it is recognized that those persons skilled in the art may make various changes, additions, and modifications to the preferred embodiment without departing from the spirit or scope of the invention.

DESCRIPTION OF THE EMBODIMENTS

Figure 1:
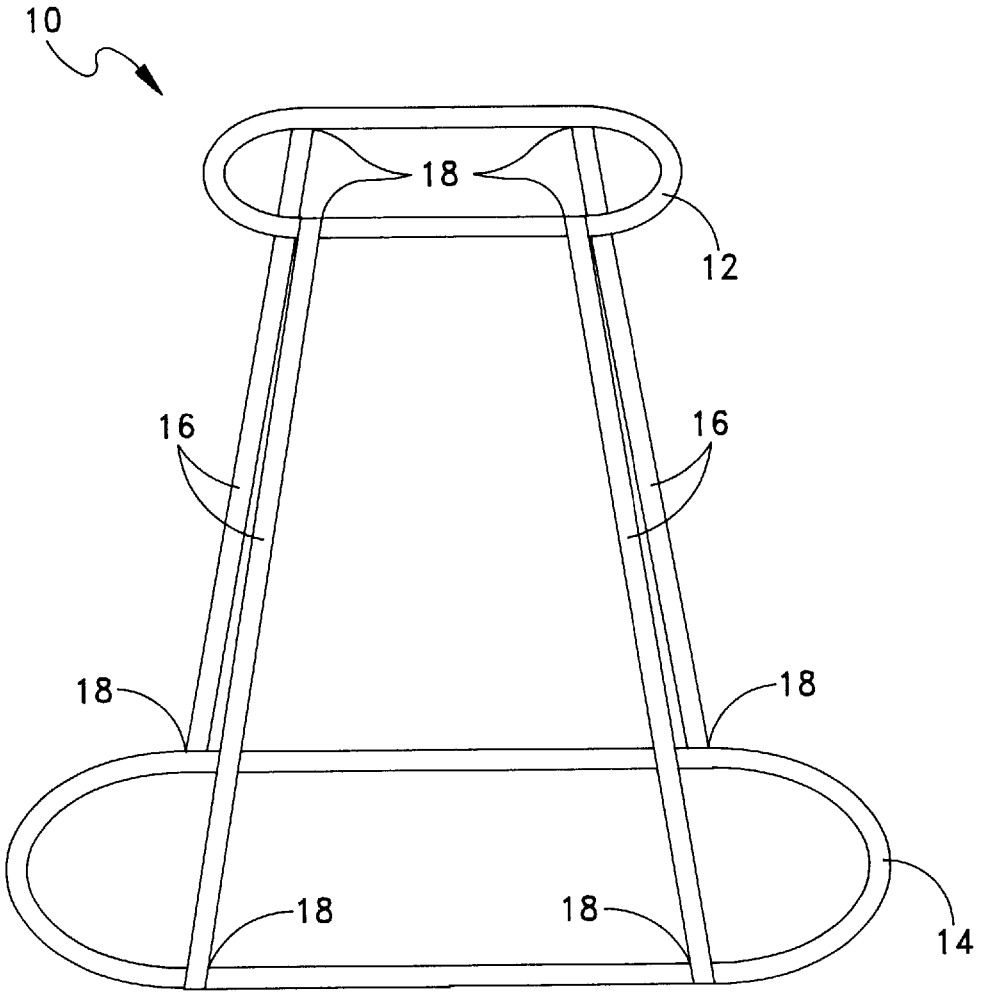
FIG. 1 (PRIOR ART)
FIG. 1 is a perspective view of a prior art single integral non-collapsible piece bag holder apparatus.

FIG. 1 of the drawings depicts a prior art sandbag holding apparatus 10. The apparatus 10 has a smaller diameter peripheral wire element 12 connected to a larger diameter peripheral wire element 14 by four vertical wire elements 16 spaced apart and positioned about the periphery of the wire elements. The vertical wire elements are welded at points 18 to the two peripheral wire elements 12 and 14 to provide for a secure, non-collapsible sandbag holder.

Figure 2:
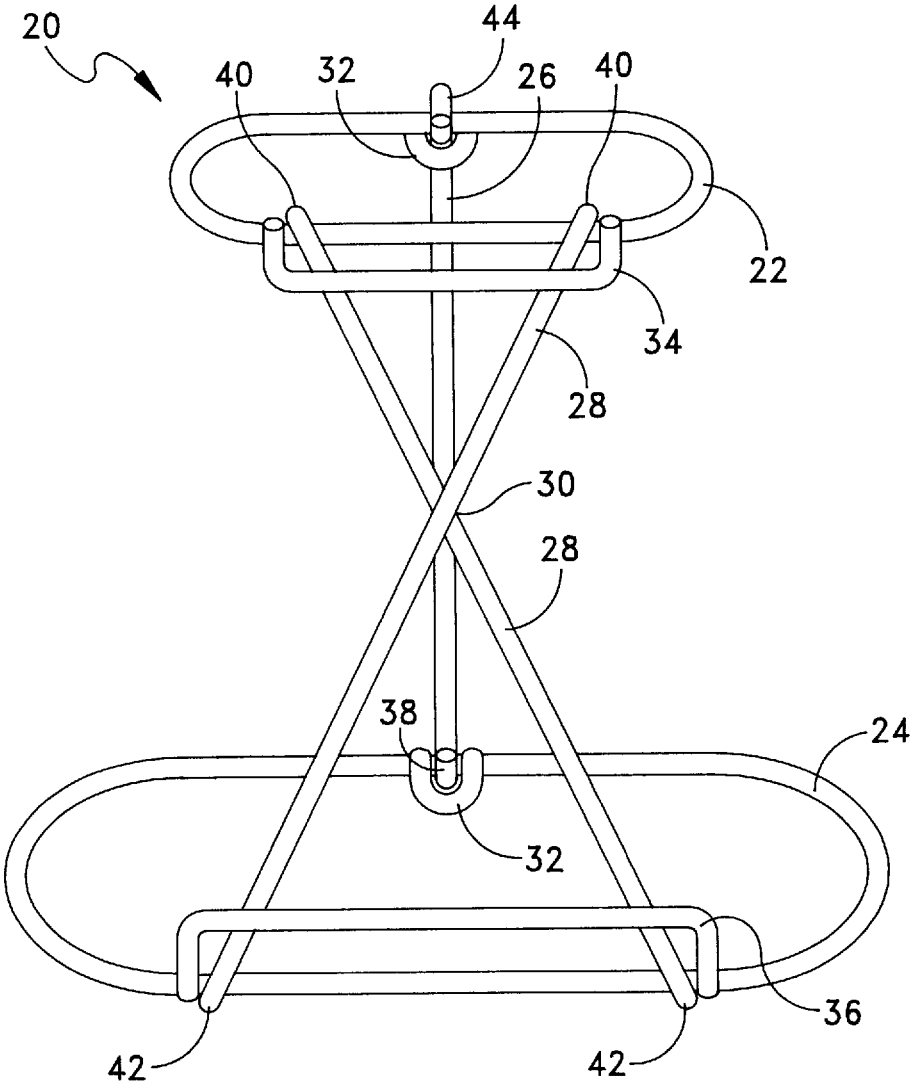
FIG. 2 is a perspective view of the bag holder apparatus of the invention in an assembled use position.
Figure 3:
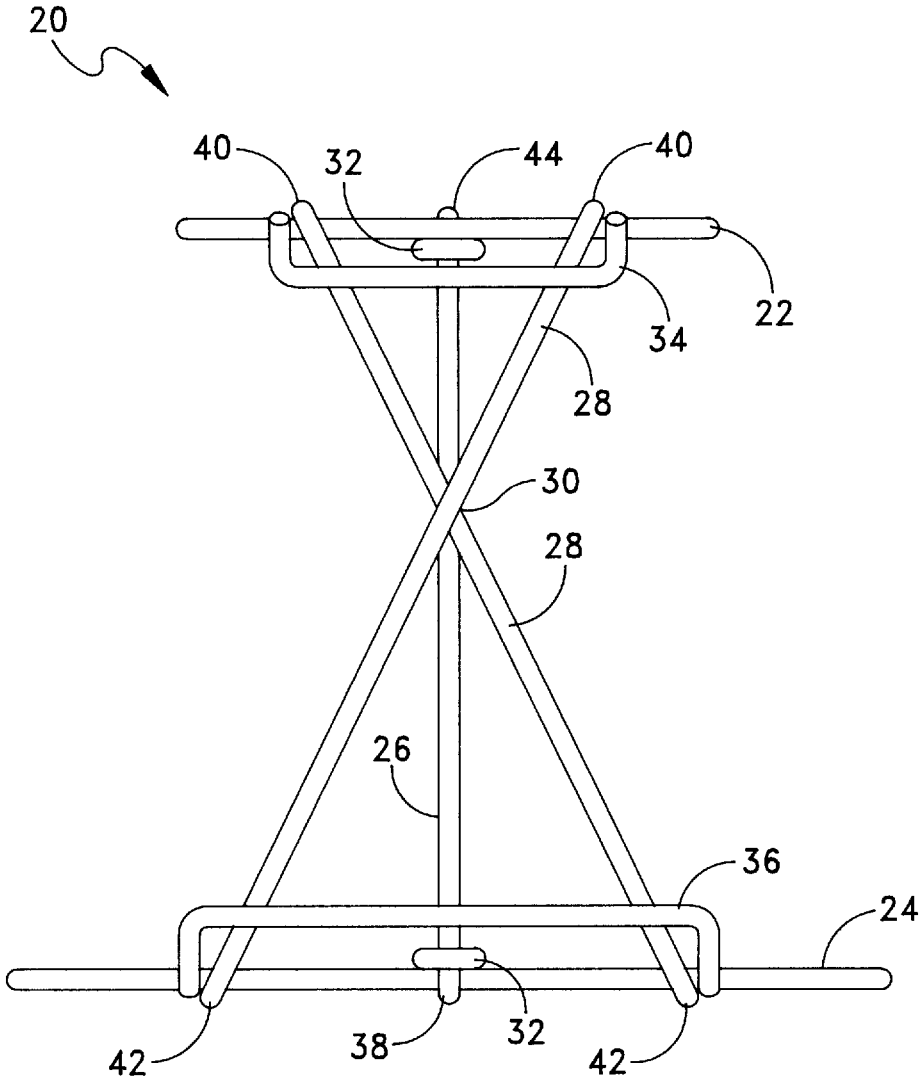
FIG. 3 is a front elevational view of the bag holder of FIG. 2.
Figure 4:
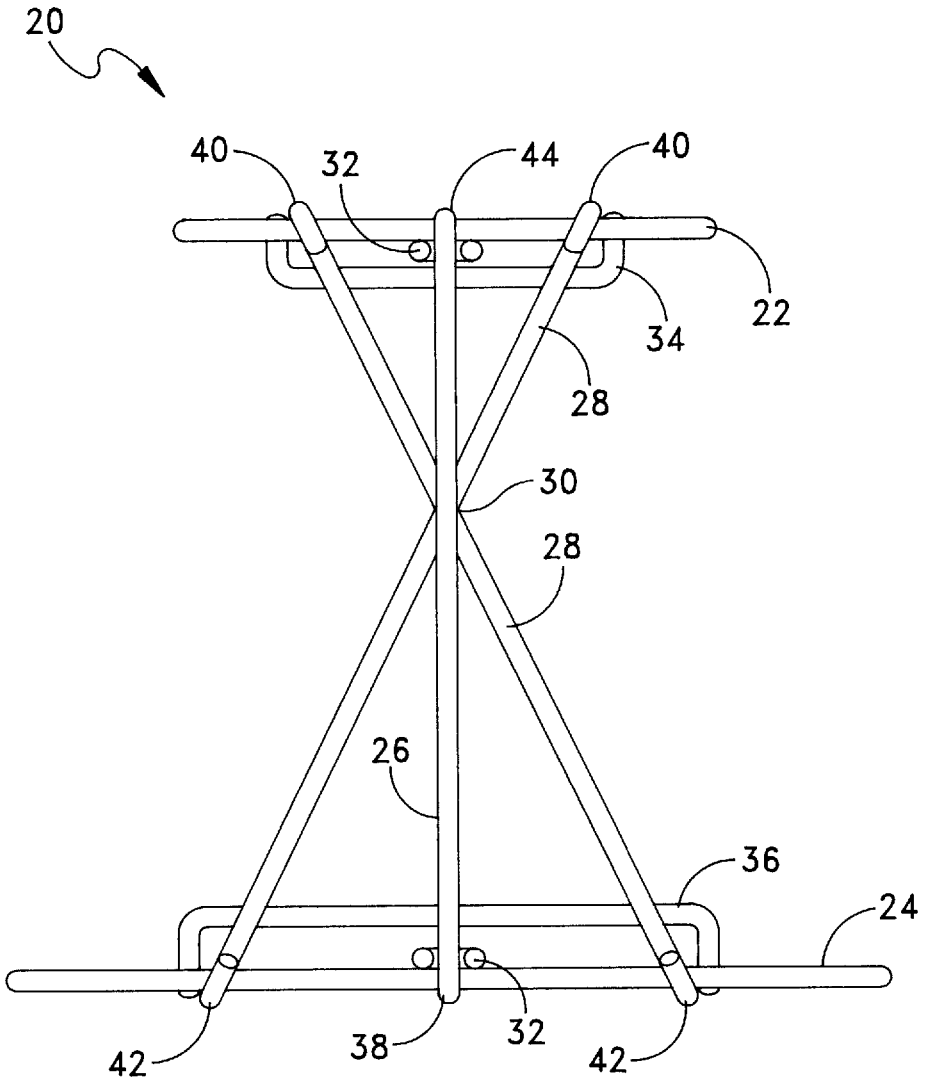
FIG. 4 is a rear elevational view of the bag holder of FIG. 2.

FIG. 2 shows the sandbag holder apparatus of the invention 20 with smaller diameter peripheral top wire element 22 and larger diameter peripheral bottom wire element 24. The two peripheral wire elements 22 and 24 are connected at a spaced apart, oppositely aligned, central point by vertical crossed wire elements 28, comprised of two straight vertical wires 28 crossed over and welded at their point of juncture 30, and which crossed wires have rounded teardrop hinges at the top 40 and bottom 42 respectively, and by a single vertical wire element 26, having a secure loop hinge 44 at the top and a removable snap-hook hinge 38 at the bottom.

These crossed 28 and singular 26 vertical wires are positioned on the peripheral wire elements 22 and 24 by retaining wires 32, 34 and 36 respectively. U-shaped retaining wire 32 retains the single vertical wire element 26 at its point of attachment to the top 22 and bottom 24 peripheral wire elements. Elongated top and bottom wire retaining elements 34 and 36 provide for retainment of the crossed wire element 28, and provides a means to fold over the top edge of a sandbag in the retaining element 34 to further secure the bag in the holder during use.

Figure 6:
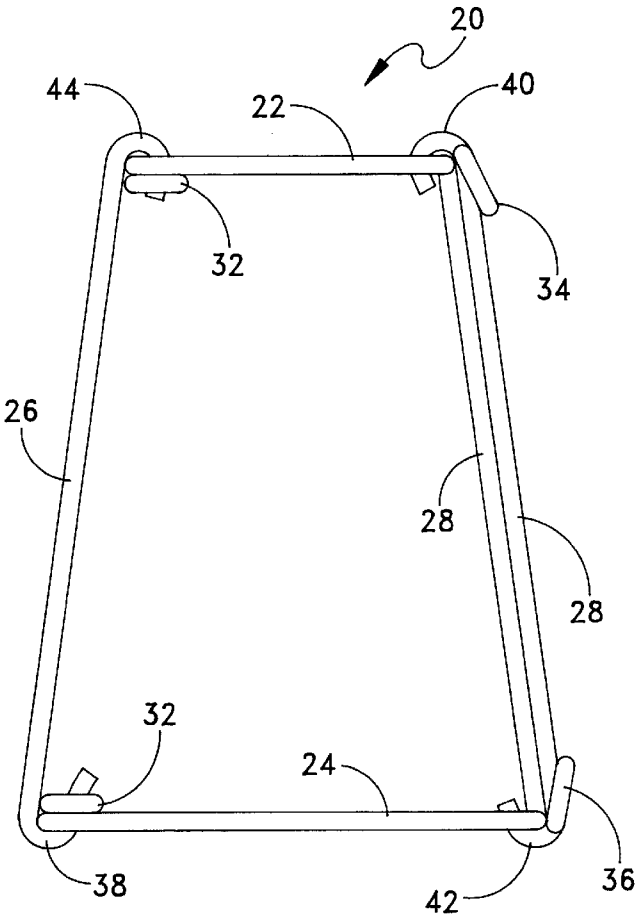
FIG. 6 is a side plan view of the opposite side of the bag holder of FIG. 2.
Figure 5:
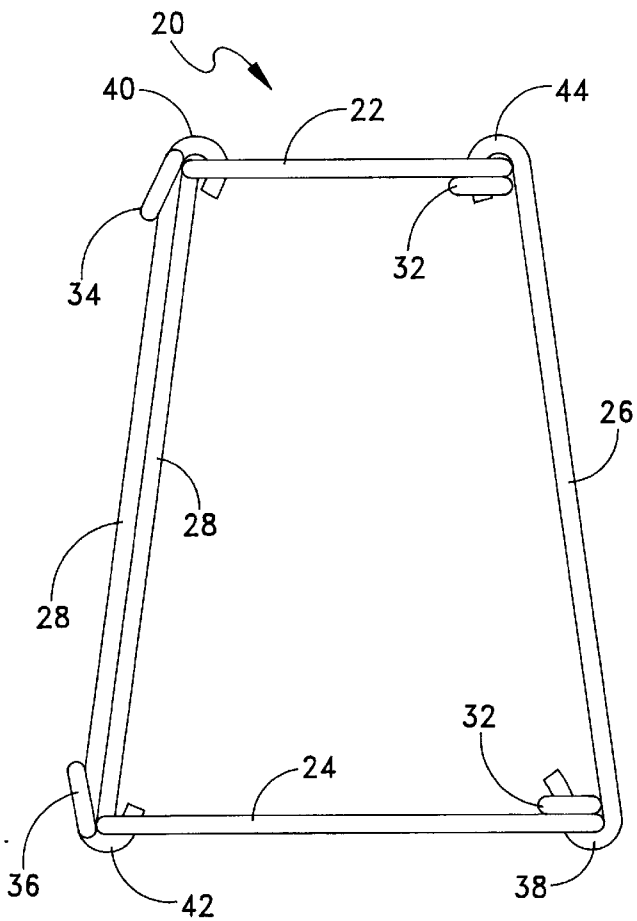
FIG. 5 is a side plan view of the bag holder of FIG. 2.
Figure 8:
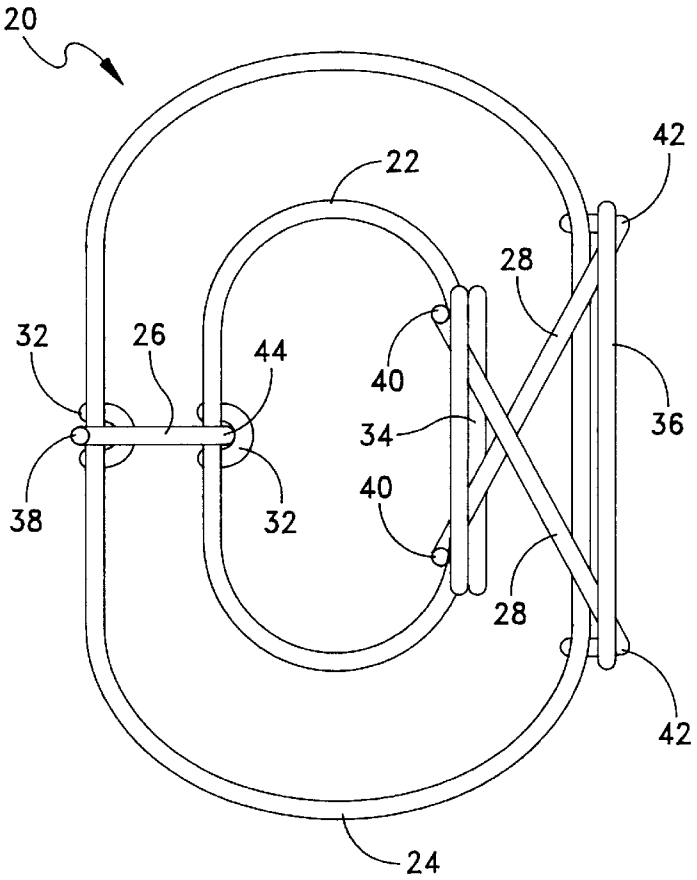
FIG. 8 is a bottom plan view of the bag holder of FIG. 2.
Figure 7:
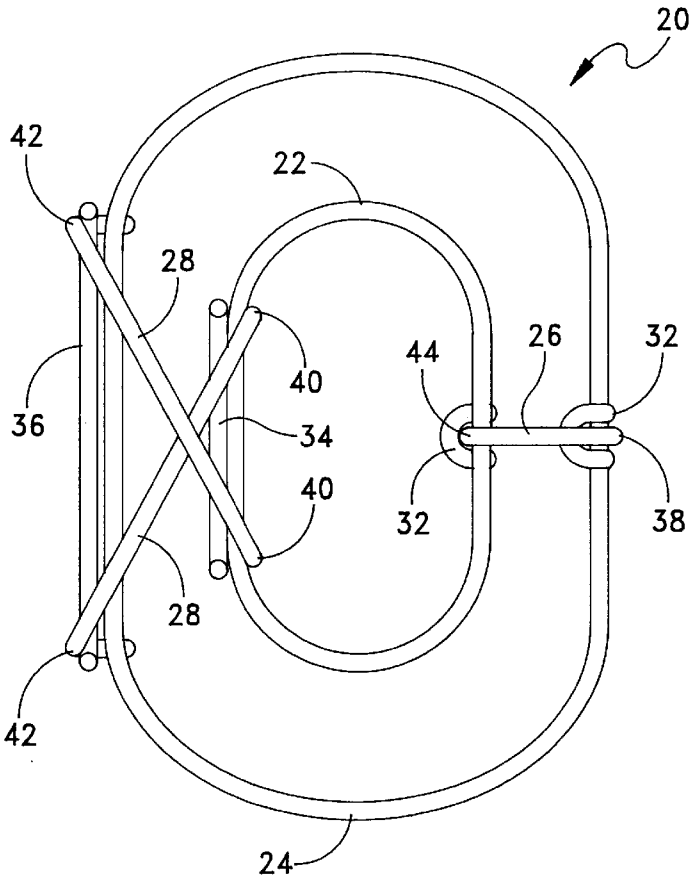
FIG. 7 is a top plan view of the bag holder of FIG. 2.

FIGS. 3–8 show the sandbag holder of the invention 20 from different views to further illustrate the various components of the invention. In particular, FIGS. 5 and 6 show side elevations of the sandbag holder 20, with the fixed rounded hinges 40, 42 and 44 of the vertical connector elements 26 and 28 respectively and are retained in position by elongated retaining elements 34 and 36, and the removably secured hook 38 is retained by U-shaped retainer 32.

Figure 9:
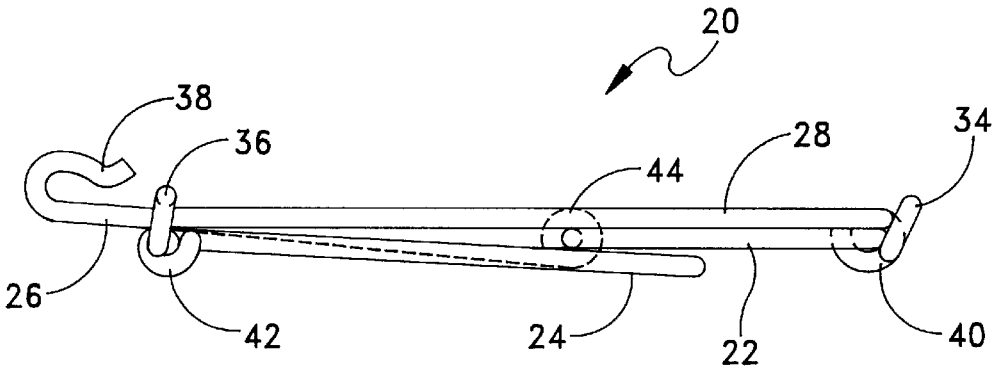
FIG. 9 is a side elevational view of the bag holder of FIG. 2 in a non-assembled, non-use position.

FIG. 9 shows the invention 20 in the unassembled, compact non-use position, with the top 22 and bottom 24 peripheral wire elements folded in on themselves. The single vertical wire element 26 is shown extending from the peripheral wire elements, with the removable snap-hook element 38 shown at the other end. The crossed wire element 28 is shown folded within the peripheral wire elements.

Figure 10:
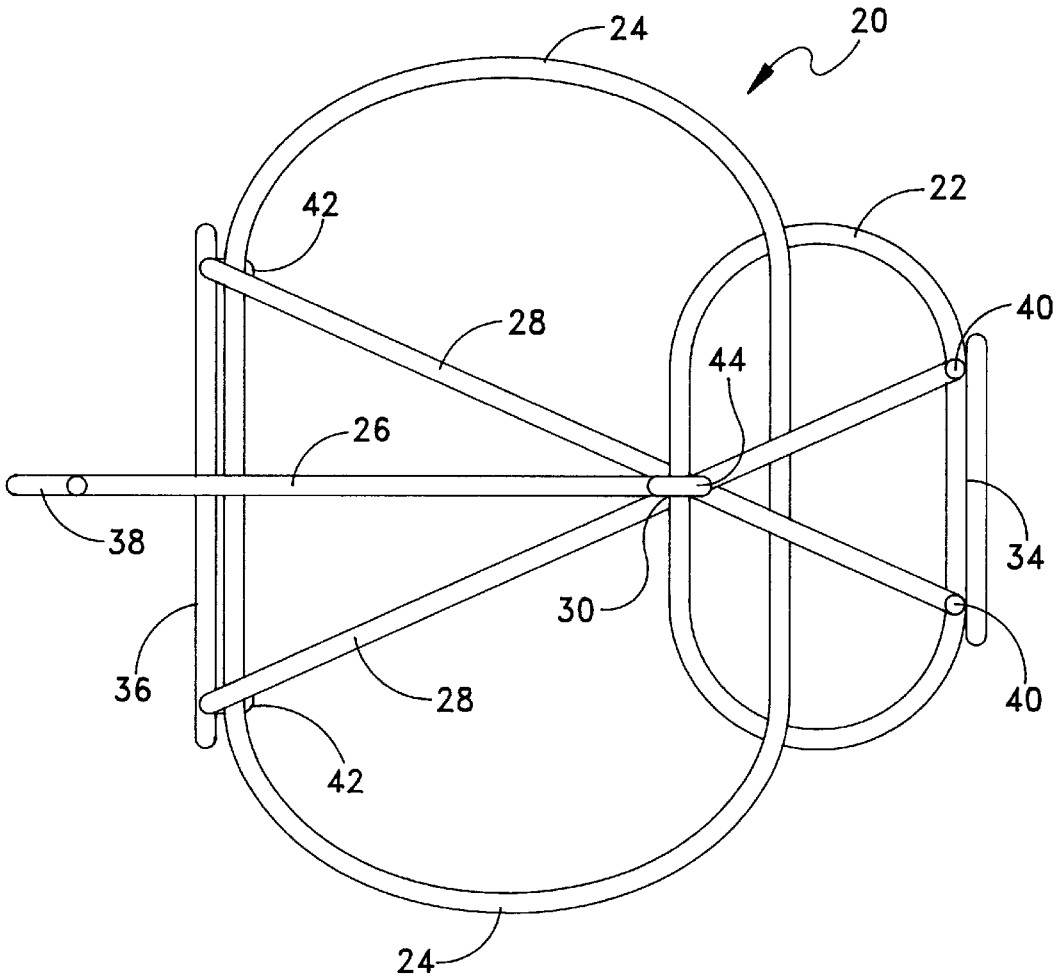
FIG. 10 is a top plan view of the bag holder of FIG. 9.

FIG. 10 shows the invention 20 in the unassembled, compact non-use position in a top plan view, further illustrating the top 22 and bottom 24 peripheral wire elements resting on each other, the single vertical wire element 26 extending therefrom, and the crossed wire elements 28 connecting the two peripheral wire elements 22 and 24.

Figure 11:
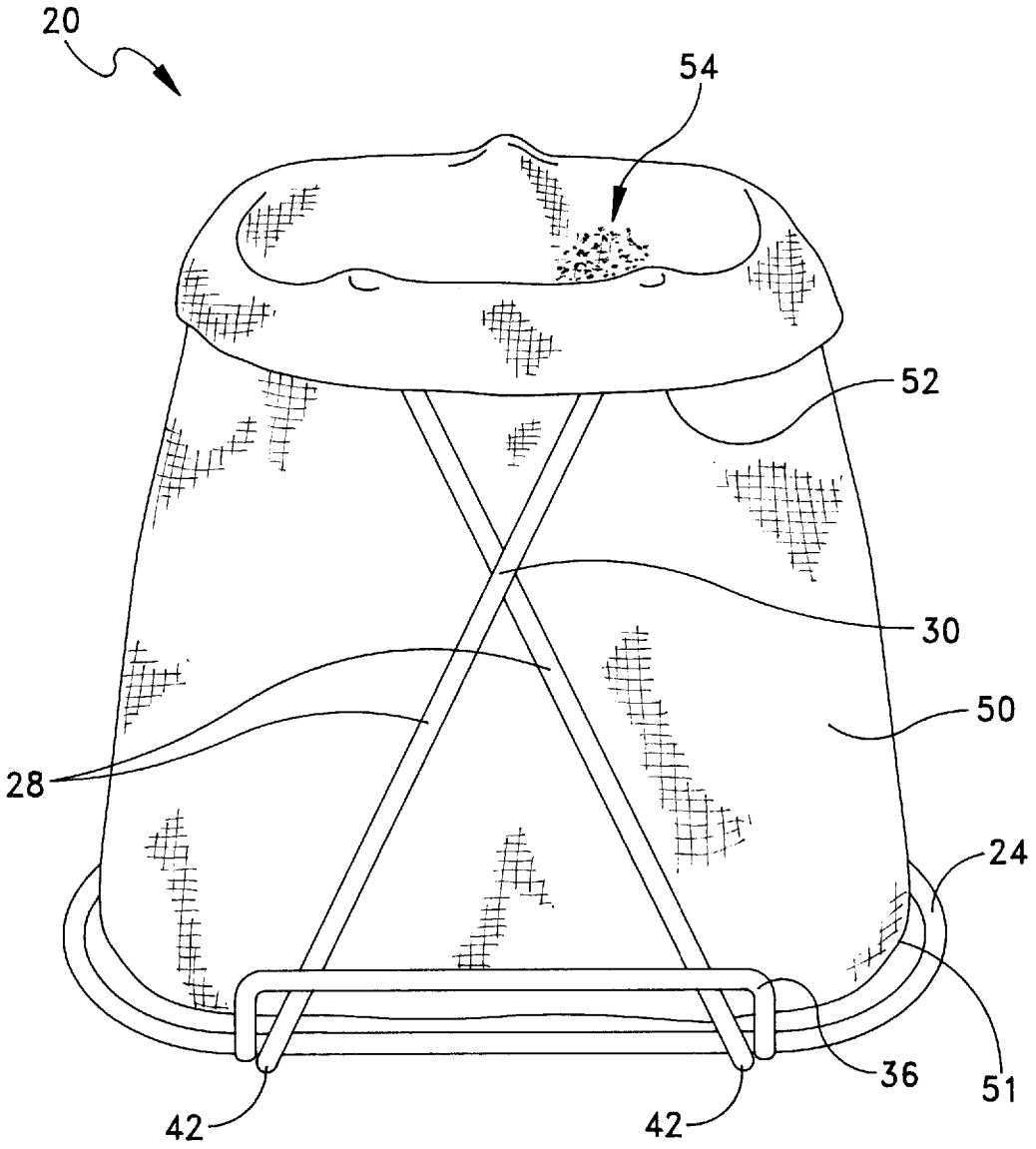
FIG. 11 is a perspective view of the bag holder of FIG. 2 supporting a bag during filling.

FIG. 11 shows the sandbag holder of the invention 20 with a sandbag inserted therein. The bag 50 is placed inside the holder 20 with the bottom of the bag 51 resting on the ground inside the bottom peripheral wire element 24. The top peripheral edge 52 of the bag 50 is folded over the top peripheral wire element 22 and further secured beneath the top elongated retaining element 34. Thus inserted, the bag is secured and the user is able to have both hands free to fill the bag with particulate matter 54.

In use, the sandbag holder 20 is transported in its compact, nonassembled position to a location requiring sandbags to be filled, such as an emergency situation, such as a flood or other emergency requiring support from sandbags or the like. The sandbag holder is quickly and easily assembled by the user by placing the bottom peripheral wire element 24 on a ground or other support surface and merely raising the top peripheral wire element 22 to a position parallel to the bottom peripheral wire element 24, and attaching the removable hook element 38 within the U-shaped retaining wire 32 on the bottom peripheral wire element 24. A sandbag is then placed within the holder and secured by folding over the open end of the bag and securing it around the periphery of the top peripheral wire element 22. The bag is then ready to be filled and sealed as desired for use.

What is claimed is:

1. A bag holder apparatus to facilitate the filling of a bag having an open end with material, which bag holder apparatus moves between a collapsible, generally flat non-use position and an upright, assembled use position for supporting and filling purposes and which bag holder comprises:

a) a peripheral bottom wire element to form a bottom base stand for the apparatus;

b) a peripheral top wire element spaced apart from and generally directly above the bottom wire element and having about the same dimensions of the open end of the bag to be filled and smaller in dimensions than the bottom wire element;

c) a spaced apart top cross wire support element having spaced apart top ends and spaced apart bottom ends, the top ends and bottom ends hingedly secured respectively to said top wire element and said bottom wire element;

d) a single wire support element spaced apart generally opposite the cross wire support element and having a top end and a bottom end, each end hingedly secured respectively to said top and bottom peripheral wire elements, and at least one of which said single wire top or bottom ends are removably snap fastened; and e) retaining means to retain the crossed wire support element and to support the apparatus in the upright use position.

2. The apparatus of claim 1 wherein the top peripheral wire element has a general oval shape.

3. The apparatus of claim 1 wherein the bottom peripheral wire element has a general oval shape.

4. The apparatus of claim 1 wherein the crossed wire is secured at an intersection of the crossed wires.

5. The apparatus of claim 1 wherein the retaining means comprise a U-shaped top wire element secured at each end to the top peripheral wire element and angled slightly downward from the plane of the top peripheral wire element and wherein the top ends of the crossed wire element are hingedly secured within the top U-shaped retaining element and contact and are supported by the top retaining wire element in the assembled use position.

6. The apparatus of claim 1 wherein the retaining means comprises a U-shaped bottom wire element secured at each end to the bottom peripheral wire element and angled generally upwardly from the planes of the bottom peripheral wire element and wherein the bottom ends of the crossed wire element are hingedly secured within the bottom U-shaped retaining wire element and contact and are supported by the bottom wire retaining element in the assembled use position.

7. The apparatus of claim 1 wherein all the top and bottom wire element ends are hingedly secured by bending the wire elements to form an end hook.

8. The apparatus of claim 1 wherein the wire elements comprise a steel wire having a diameter of about ⅛" to ¼".

9. The apparatus of claim 1 wherein the top and bottom peripheral wire elements are oval-shaped with dimensions of a minor axis of about 8 to 11 inches and a major axis of about 10 to 14 inches and the apparatus in the assembled use position has a height of about 14–18 inches.

10. In combination, the apparatus of claim 1 in an assembled use position and a bag having an open top end to receive material therein, the bag within the apparatus and having the open end held open within the top peripheral wire elements and with the bag top end rolled over the top peripheral wire element to retain the bag in an open end filling position.

11. In combination, the apparatus of claim 1 and an open ended bag to be supported by the apparatus.

12. A bag holder apparatus to facilitate the filling of a bag having an open end with material, which bag holder apparatus moves between a collapsible, generally flat non-use position and an upright, assembled use position for supporting and filling purposes and which bag holder comprises:

a) a peripheral oval bottom wire element to form a bottom base stand for the apparatus;

b) a peripheral oval top wire element spaced apart from and generally directly above the bottom wire element and having about the same dimensions of the open end of the bag to be filled and smaller in dimensions than the bottom wire element;

c) a spaced apart top cross wire support element having spaced apart top ends and spaced apart bottom ends, the top ends and bottom ends hingedly secured respectively to said top wire element and said bottom wire element, which cross wire is secured at the intersection of the cross wires;

d) a single wire support element spaced apart generally opposite the cross wire support element and having a top end and a bottom end, each hingedly secured respectively to said top and bottom peripheral wire elements, and at least one of which said single wire top or bottom ends are removably snap fastened;

e) retaining and support means to retain and support the bag holder apparatus in the assembled use position, wherein the retaining and support means comprise a pair of U-shaped retaining wire elements, one U-shaped wire element secured at each end to the top peripheral wire element and the other U-shaped wire element secured at each end to the bottom peripheral wire element, and both U-shaped wire elements angled slightly from the plane of the top and bottom peripheral wire elements, and wherein the top and bottom ends of the cross wire element are within the U-shaped retaining elements and are supported in the assembled use position.

13. A method of filling an open-ended bag with material, which method comprises:

a) providing a bag holder which comprises:

i) a peripheral bottom wire element to form a bottom base stand for the apparatus;

ii) a peripheral top wire element having about the same dimensions of the open end of the bag to be filled and smaller in dimensions than the bottom wire element;

iii) a spaced apart top cross wire support element having spaced apart top ends and spaced apart bottom ends, the top ends and bottom ends hingedly secured respectively to said top wire element and said bottom wire element;

iv) a single wire support element having a top end and a bottom end, each hingedly secured respectively to said top and bottom peripheral wire elements, and at least one of which said single wire top or bottom ends are removably snap fastened; and v) retaining means to retain the cross wire support element to the top and bottom peripheral wire elements, and to support the apparatus in the upright use position;

b) placing the apparatus in an upright assembled use position;

c) placing an open-ended bag to be filled within the top and bottom peripheral wire elements;

d) extending the material of the bag at the open end over and about the top peripheral wire element to place the open end of the bag in an open supported position within the apparatus; and e) filling the bag with material in the open end supported position.

14. The method of claim 13 wherein the said bag comprises a sandbag and said material comprises sand or soil material.

15. The method of claim 13 which includes closing the open end of the bag and removing the closed filled bag from the apparatus.

* * * * *